US008347615B2

(12) United States Patent
Host et al.

(10) Patent No.: US 8,347,615 B2
(45) Date of Patent: Jan. 8, 2013

(54) EXHAUST FLOW DIRECTOR AND CATALYST MOUNT FOR INTERNAL COMBUSTION ENGINE

(75) Inventors: Ray Host, Mt. Clemens, MI (US); Isabelle Groome, Dearborn, MI (US)

(73) Assignee: Ford Global Technologies, Dearborn, MI (US)

( * ) Notice: Subject to any disclaimer, the term of this patent is extended or adjusted under 35 U.S.C. 154(b) by 1625 days.

(21) Appl. No.: 11/422,615

(22) Filed: Jun. 7, 2006

(65) Prior Publication Data

US 2007/0283687 A1 Dec. 13, 2007

(51) Int. Cl.
*F01N 13/10* (2010.01)

(52) U.S. Cl. ..... 60/323

(58) Field of Classification Search ..... 60/302, 60/323; 123/58.1

See application file for complete search history.

(56) References Cited

U.S. PATENT DOCUMENTS

| | | | | |
|---|---|---|---|---|
| 3,109,416 | A * | 11/1963 | Hurst et al. | 123/58.1 |
| 5,220,789 | A * | 6/1993 | Riley et al. | 60/302 |
| 5,996,339 | A * | 12/1999 | Gottberg et al. | 60/299 |
| 6,324,838 | B1 * | 12/2001 | Stempien et al. | 60/323 |
| 6,324,839 | B1 * | 12/2001 | Canini et al. | 60/323 |
| 6,487,854 | B2 * | 12/2002 | Maus | 60/324 |
| 6,604,358 | B2 * | 8/2003 | Durr et al. | 60/323 |
| 6,840,039 | B2 | 1/2005 | Huh | |

* cited by examiner

*Primary Examiner* — Thomas Denion
*Assistant Examiner* — Jonathan Matthias
(74) *Attorney, Agent, or Firm* — Jerome R. Drouillard; Julia Voutyras

(57) ABSTRACT

An exhaust flow director and catalyst mount for an internal combustion engine includes a collector chamber with an outlet flange adapted for direct connection with an exhaust treatment catalyst. A number of transitional guide vanes located within the collector chamber direct exhaust gases flowing from runners into the collector chamber. The runners attaching exhaust flanges and the outlet flange of the present device are substantially coplanar.

16 Claims, 3 Drawing Sheets

EXHAUST FLOW DIRECTOR AND CATALYST MOUNT FOR INTERNAL COMBUSTION ENGINE

BACKGROUND OF THE INVENTION

1. Field of the Invention

The present invention relates to an exhaust flow director and catalyst mount for internal combustion engine which serves not only as an exhaust manifold for collecting exhaust gases exiting the cylinder head of an engine, but also for a directly mounted exhaust after treatment catalyst.

2. Disclosure Information

Exhaust manifolds or exhaust headers have been used on multi-cylinder reciprocating internal combustion engines for many years. Known exhaust manifolds or headers simply collect the gases passing from the cylinder head exhaust ports and convey the gases to an exhaust pipe. Typically, the catalyst is contained downstream of the exhaust pipe.

Although close coupled catalysts are known in the automotive world, such catalysts are generally not mounted with their inlets in a coplanar relationship with the exhaust runners. As a result, the flow velocities across the catalyst are not uniform and often are diminished because of flow and thermal losses within the exhaust manifold. Accordingly, U.S. Pat. No. 6,840,039 discloses an exhaust manifold including a converging-diverging section upstream from a catalyst. Apparently, an avowed purpose of the converging-diverging section is to reduce exhaust heat, but this will cause the decided disadvantage of increasing catalyst light-off time.

An exhaust flow director and catalyst mount according to the present invention provides superior flow direction for the individual flows entering exhaust collector chamber from the manifold runners, so as to provide uniform velocity distribution and also uniform temperature distribution to the front face of the catalyst which is mounted directly to the outlet flange, while preserving the exhaust heat. This promotes faster catalyst light-off.

SUMMARY OF THE INVENTION

An exhaust flow director and catalyst mount for an internal combustion engine includes a collector chamber having an outlet structure adapted for connection with an exhaust treatment catalyst and a plurality of exhaust flanges adapted for mounting to a plurality of exhaust ports exiting from the cylinder head of an engine. Exhaust runners extend from each of the exhaust flanges to the collector chamber. A number of transitional guide vanes located within the collector chamber direct exhaust gases flowing from the runners and into the collector chamber at uniform velocity and temperature distribution. These transitional guide vanes are formed integrally with at least one wall of the collector chamber. The guide vanes are configured such that the gases leaving the collector chamber have uniform flow velocity profile.

According to another aspect of the present invention, the collector chamber, the exhaust flanges, and the exhaust runners are arranged such that a fastener/driver having a plurality of parallel spindles may be used to simultaneously drive a number of fasteners for attaching the exhaust flow director and catalyst mount to the cylinder head of an engine. The outlet structure of the collector chamber and exhaust runners are generally coplanar. The included angle between the outlet flange of the collector chamber and the plane of the exhaust flanges is approximately 45 degrees.

According to another aspect of the present invention, a reciprocating internal combustion engine for an automotive vehicle includes a cylinder block, a cylinder head mounted upon the cylinder block, and an exhaust flow director, catalyst mount, and exhaust treatment catalyst for the engine.

The present flow director and catalyst mount is preferably constructed of cast metal such as cast ferrous metals, more precisely known as cast iron and/or cast steel.

It is an advantage of an exhaust flow director and catalyst mount according to the present invention that the distances between the engine's exhaust ports and the front face of the catalyst are minimized, but in the context of a flow director and catalyst mount which may be attached to the engine in a single operation.

It is a further advantage of an exhaust flow director and catalyst mount according to the present invention that catalyst efficiency is improved because the exhaust gases reach the catalyst at a higher temperature and with a more uniform flow velocity. Uniform flow velocity translates to more efficient utilization of the entire volume of the catalyst, thereby improving catalyst efficiency.

It is a further advantage of a exhaust flow director and catalyst mount according to the present invention that because the catalyst receives exhaust gases in a most efficient manner, avoiding both thermal and fluid flow losses, it is possible with some vehicles to eliminate underbody catalysts, yielding a large concomitant cost savings. Moreover, in the case of one automotive engine, it was possible to produce an additional 15 horsepower from a 3.5 L engine by deleting unneeded underbody catalysts. This power increase is attributable to a reduction in exhaust backpressure.

It is yet another advantage of an exhaust flow director and catalyst mount according to the present invention that removing catalysts from the underbody of the vehicle results in less heat build within the passenger compartment of the vehicle.

Other advantages as well as features and objects of the present invention will become apparent to the reader of this specification.

BRIEF DESCRIPTION OF THE DRAWINGS

FIG. 2 further includes cylinder block 15, cylinder head 18, and exhaust port 34.

DETAILED DESCRIPTION OF THE PREFERRED EMBODIMENT

Figure 1:
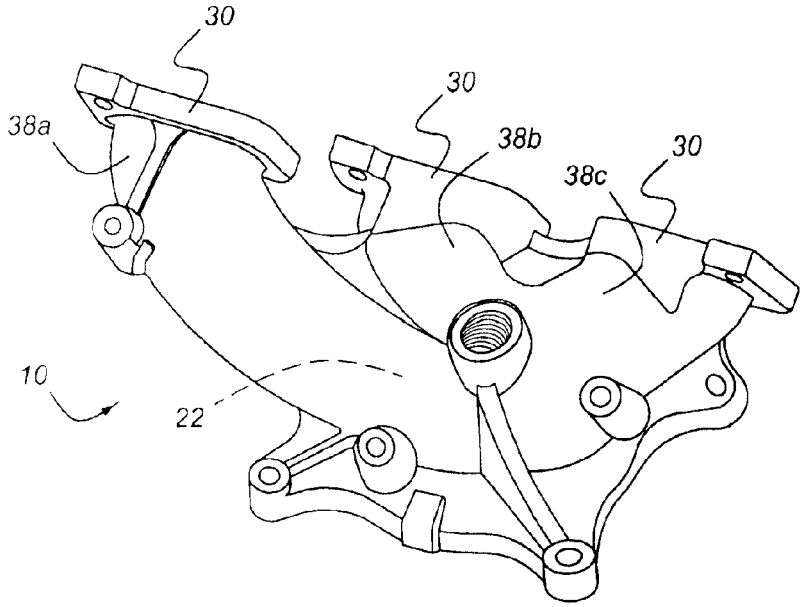
FIG. 1 is a perspective view of an exhaust flow director and catalyst mount for internal combustion engine, according to the present invention.

As shown in FIG. 1, exhaust flow director and catalyst mount 10 attach to an engine by means of exhaust flanges 30. Exhaust runners 38A, 38B and 38C extend from each exhaust flange 30 to a collector chamber 22, which is shown with particularity in FIGS. 3 and 4. FIG. 4 also shows velocity profile P, across front face 50 of leading catalyst element 48. Exhaust catalyst 46 shown in FIG. 4 has two bricks or monolithic substrates 48 and 54. As shown in FIG. 4, the velocity profile is generally uniform. This means that the entire catalyst will be used to accomplish the required exhaust after treatment.

Figure 2:
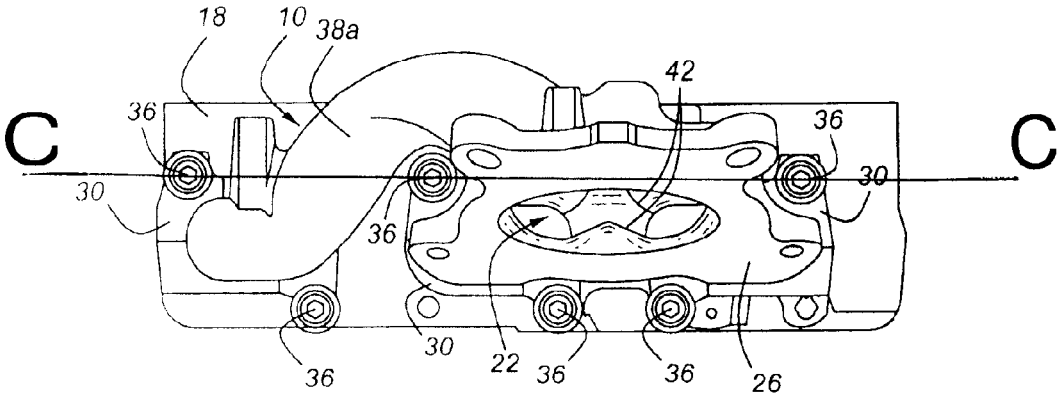
FIG. 2 is a plan view of the present exhaust flow director and catalyst mount showing this device mounted to the cylinder head, 18, of an engine with a number of threaded fasteners.

The uniform velocity profile illustrated in FIG. 4 is achieved in part by means of guide vanes which are formed integrally with the walls of collector chamber 22. Two guide vanes are shown in FIG. 2 at 42. Guide vanes 42, in combination with the placement of exhaust runners 38, cause a swirling component in the flow so that the portions of exhaust, in the illustrated example numbering three are turned and directed down into different, but overlapping, portions of front face 50 of catalyst 46 such that a uniform flow distribution is achieved prior to the midbed portion of catalyst leading element 48. Because exhaust gases are caused to flow through runners 38 and collector chamber 22 and into catalyst 46 without excessive scrubbing of the collector chamber walls, heat loss in the exhaust gases is minimized. This is a marked contrast from many prior art exhaust handling devices.

FIG. 2 shows a further important feature of an exhaust flow director and catalyst mount according to the present invention inasmuch as exhaust flanges 30, exhaust runners 38, and outlet flange 26 are generally coplanar, as indicated by the plane line C-C of FIG. 2. This allows access to all of fasteners 36 simultaneously, so as to permit fastening of exhaust flow director 10 to an engine in a single operation. Once flow director 10 has been attached to an engine, catalyst 46 (FIGS. 3 and 4) may be mounted to the flow director.

FIG. 4 shows an installed advantage of the present exhaust flow director and catalyst mount inasmuch as catalyst 46 is shown as being connected directly to the flow director with a generous collector/chamber smoothing and guiding the flow into the catalyst brick as shown in FIG. 4.

Figure 3:
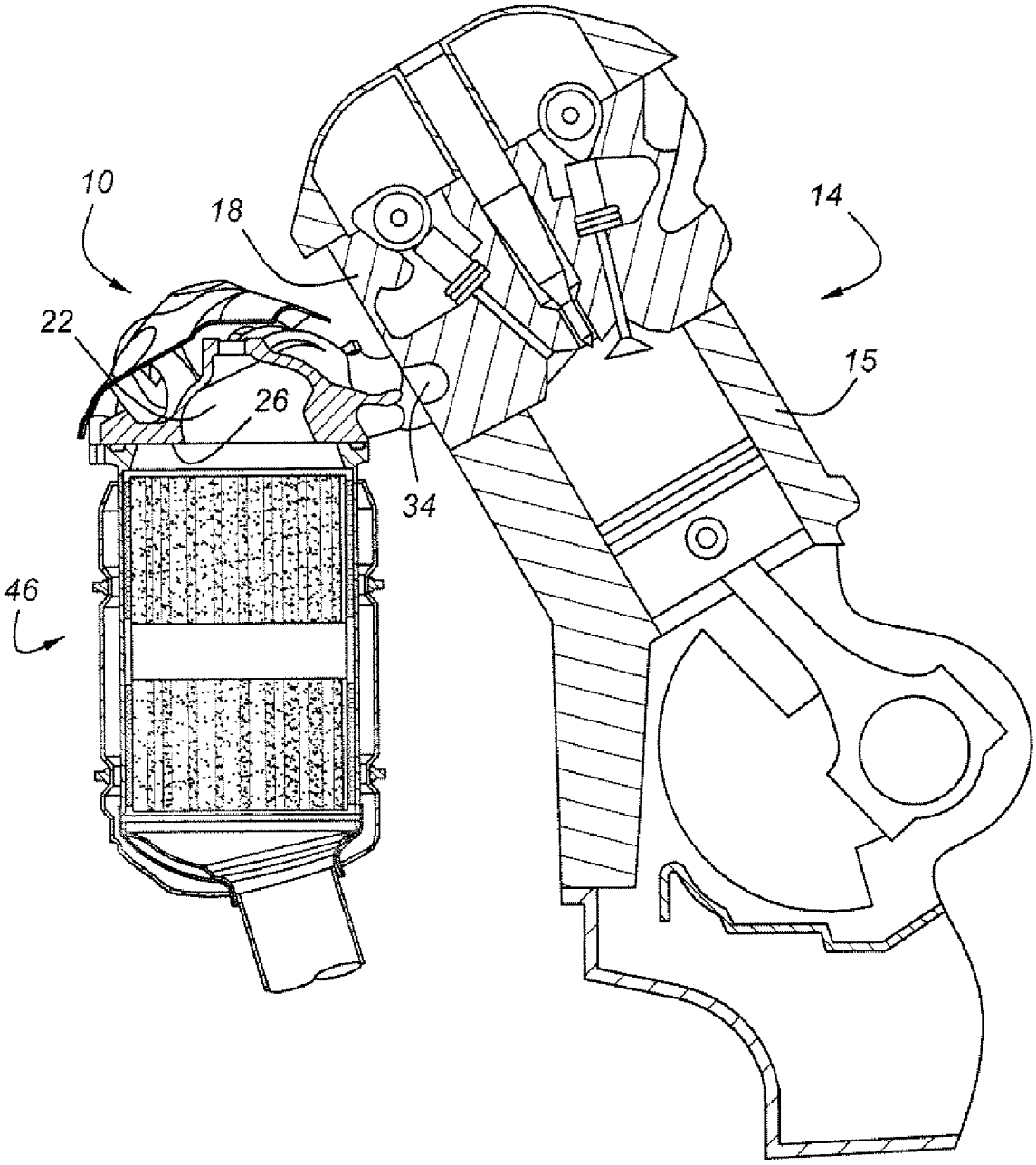
FIG. 3 is a sectional view through an internal combustion engine, 14, according to the present invention having the exhaust flow director and catalyst mount.
Figure 4:
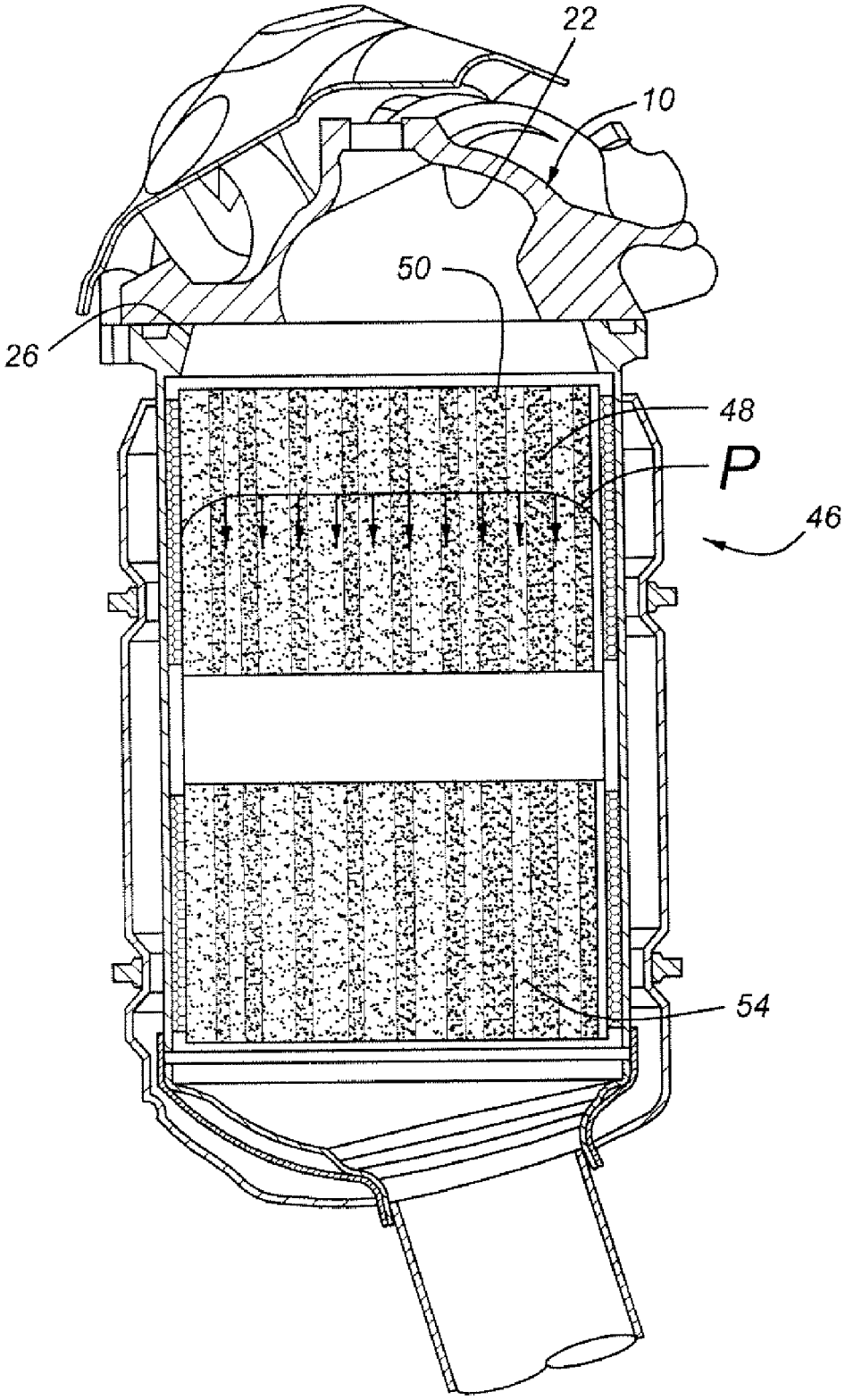
FIG. 4 is an enlarged view of the exhaust flow director and catalyst mount shown in FIG. 3.

It is also seen from FIG. 3 that the packaging space required for the present exhaust flow director and catalyst is minimized because intermediate pipes as well as, for that matter, an underbody catalyst, can and have been eliminated.

While particular embodiments of the invention have been shown and described, numerous variations and alternate embodiments will occur to those skilled in the art. Accordingly, it is intended that the invention be limited only in terms of the appended claims.

What is claimed is:

1. An exhaust flow director and catalyst mount for an internal combustion engine, comprising:

a collector chamber having an outlet structure adapted for connection with an exhaust treatment catalyst;

a plurality of exhaust flanges adapted for mounting to a plurality of exhaust ports exiting from a cylinder head of an engine;

a plurality of exhaust runners, with one of said runners extending from each of said exhaust flanges to said collector chamber; and a plurality of transitional guide vanes, located within said collector chamber, for directing exhaust gases flowing from the runners and into the collector chamber.

2. An exhaust flow director and catalyst mount according to claim 1, wherein said transitional guide vanes are formed integrally with at least one wall of said collector chamber.

3. An exhaust flow director and catalyst mount according to claim 1, wherein said transitional guide vanes and said exhaust runners are configured such that gases leaving said collector chamber are turned and directed into different, but overlapping, portions of a catalyst attached to said flow director and catalyst mount, such that a uniform flow distribution is achieved through the catalyst.

4. An exhaust flow director and catalyst mount according to claim 1, wherein said collector chamber, said exhaust flanges, and said exhaust runners are arranged such that a fastener driver having a plurality of parallel spindles may be used to simultaneously drive a plurality of fasteners for attaching said exhaust flow director and catalyst mount to a cylinder head of an engine.

5. An exhaust flow director and catalyst mount according to claim 1, wherein the included angle between said outlet structure of said collector chamber and the plane of said plurality of exhaust flanges is approximately 45 degrees.

6. An exhaust flow director and catalyst mount according to claim 1, wherein said outlet structure of said collector chamber and said exhaust runners are generally coplanar.

7. An exhaust flow director and catalyst mount according to claim 1, wherein said outlet structure of said collector chamber is configured for direct mounting of an exhaust catalyst.

8. An exhaust flow director and catalyst mount for an internal combustion engine, comprising:

a collector chamber having an outlet flange adapted for direct connection with an exhaust treatment catalyst;

a plurality of exhaust flanges adapted for mounting to a plurality of exhaust ports exiting from a cylinder head of an engine;

a plurality of exhaust runners, with one of said runners extending from each of said exhaust flanges to said collector chamber, with said exhaust runners and said outlet flange being configured such that said outlet flange and said runners are generally coplanar; and a plurality of transitional guide vanes, located within said collector chamber, for directing exhaust gases flowing through the runners and into different portions of said collector chamber.

9. An exhaust flow director and catalyst mount according to claim 8, wherein said flow director and catalyst mount comprises cast metal.

10. An exhaust flow director and catalyst mount according to claim 9, wherein said flow director and catalyst mount comprise cast ferrous metal.

11. An exhaust flow director, catalyst mount, and exhaust treatment catalyst for an internal combustion engine, comprising:

a collector chamber having an outlet flange adapted for connection with an exhaust treatment catalyst;

a plurality of exhaust flanges adapted for mounting to a plurality of exhaust ports exiting from a cylinder head of an engine;

a plurality of exhaust runners, with one of said runners extending from each of said exhaust flanges to said collector chamber;

an exhaust treatment catalyst attached directly to said outlet flange; and a plurality of transitional guide vanes, located within said collector chamber, for directing exhaust gases flowing through said runners and into said catalyst, with said guide vanes being configured so as to cause the exhaust gas velocity profile through said catalyst to be generally invariant.

12. An exhaust flow director, catalyst mount, and exhaust treatment catalyst according claim 11, wherein said exhaust treatment catalyst comprises at least one monolithic substrate.

13. An exhaust flow director, catalyst mount, and exhaust treatment catalyst according to claim 11, wherein said exhaust treatment catalyst comprises a plurality of monolithic substrates.

14. An exhaust flow director, catalyst mount, and exhaust treatment catalyst according to claim 11, wherein said outlet flange of said collector chamber and said exhaust flanges are generally coplanar.

15. A reciprocating internal combustion engine for an automotive vehicle, comprising:

a cylinder block;

a cylinder head mounted upon said cylinder block; and an exhaust flow director, catalyst mount, and exhaust treatment catalyst, comprising:

a collector chamber having an outlet flange adapted for connection with an exhaust treatment catalyst;

a plurality of exhaust flanges adapted for mounting to a plurality of exhaust ports exiting from said cylinder head;

a plurality of exhaust runners, with one of said runners extending from each of said exhaust flanges to said collector chamber;

an exhaust treatment catalyst attached directly to said outlet flange, with said catalyst having a front face adjoining the collector chamber; and a plurality of transitional guide vanes, located within said collector chamber, for directing exhaust gases flowing through said runners and into different portions of said catalyst, such that a uniform flow distribution is achieved over the front face of the catalyst.

16. An internal combustion engine according to claim 15, wherein said exhaust runners and said outlet flange are arranged in a generally coplanar configuration.

* * * * *